US006414582B1

(12) United States Patent
Brkovic et al.

(10) Patent No.: US 6,414,582 B1
(45) Date of Patent: Jul. 2, 2002

(54) LOW PROFILE SURFACE MOUNT MAGNETIC DEVICES WITH CONTROLLED NONLINEARITY

(76) Inventors: Milivoje Slobodan Brkovic, 1202 Plumtree Rd.; Apurba Roy, 2313 Camino Robledo, both of Carlsbad, CA (US) 92009

( * ) Notice: Subject to any disclaimer, the term of this patent is extended or adjusted under 35 U.S.C. 154(b) by 56 days.

(21) Appl. No.: 09/643,799

(22) Filed: Aug. 22, 2000

(51) Int. Cl.[7] ..... H01F 5/00

(52) U.S. Cl. ..... 336/200; 336/232; 336/223; 336/185; 336/96

(58) Field of Search ..... 336/200, 96, 185, 336/192, 107, 232, 223

(56) References Cited

U.S. PATENT DOCUMENTS 4,447,795 A * 5/1984 Sefko et al. ..... 336/178
4,597,169 A * 7/1986 Chamberlin ..... 29/605

* cited by examiner

*Primary Examiner*—Anh Mai
(74) *Attorney, Agent, or Firm*—Mathews, Collins, Shepherd & McKay, P.A.

(57) ABSTRACT

In accordance with the invention, a low profile magnetic device comprises a crelenated ferrite body having first and second conductive paths winding around the body. Current applied to one of the conductive windings can adjust the threshold current level in the other conductive winding at which the inductance characteristic changes to a relatively constant inductance.

8 Claims, 2 Drawing Sheets

LOW PROFILE SURFACE MOUNT MAGNETIC DEVICES WITH CONTROLLED NONLINEARITY

FIELD OF THE INVENTION

This invention relates to low profile surface mounted magnetic devices, such as inductors and transformers. In particular, it relates to such devices having controllable inductance versus current characteristics.

BACKGROUND OF THE INVENTION

Magnetic devices, such as inductors and transformers, serve a wide variety of essential functions in many electronic devices. In power supplies, for example, inductors are used as choke coils for energy storage and to minimize noise and AC ripple, and transformers are used to change voltage level and to provide isolation. Such devices are often made of a magnetic core, such as iron or ferrite, wound with conductive coils. Consequently, they are sometimes referred to as wire-wound core devices.

One major difficulty with wire-wound core devices is that they have been difficult to miniaturize. While components such as resistors, diodes, capacitors and transistors have been shrunk to the microscopic level, wire-wound core devices remain bulky and typically must be assembled as complete units before being applied to hybrid circuits.

Conveniently fabricated magnetic devices with a low surface profile are described in U.S. Pat. No. 5,574,420 issued to A. Roy et al. on Nov. 12, 1996 and entitled "Low Profile Surface Mounted Magnetic Devices and Components Therefor", which is incorporated herein by reference. In essence the devices comprise a crenelated magnetic ferrite body and a conductive path winding through recesses around the body and securing it to a substrate. The conductive path can be comprised of U-shaped conductive elements, each partially surrounding the body, and conductive strips printed on the substrate. An alternative low profile device wherein the conductive path is printed around the body is disclosed in U.S. Pat. No. 6,094, 123 issued to A. Roy on Jul. 25, 2000, which is also incorporated herein by reference.

Such devices can exhibit nonlinear inductance versus current characteristics. As the current through the winding path increases to some threshold current level, the device inductance decreases from a high inductance to a region of relatively constant inductance. This characteristic and the threshold current level are essentially fixed for each device. But for some applications it is desirable to have a device where the threshold current level can be controlled.

SUMMARY OF THE INVENTION

In accordance with the invention, a low profile magnetic device comprises a crelenated ferrite body having first and second conductive paths winding around the body. Current applied to one of the conductive windings can adjust the threshold current level in the other conductive winding at which the inductance characteristic changes to a relatively constant inductance.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It is to be understood that these drawings are for purposes of illustrating the concepts of the invention and, except for the graphs, are not to scale.

DETAILED DESCRIPTION

Figure 1:
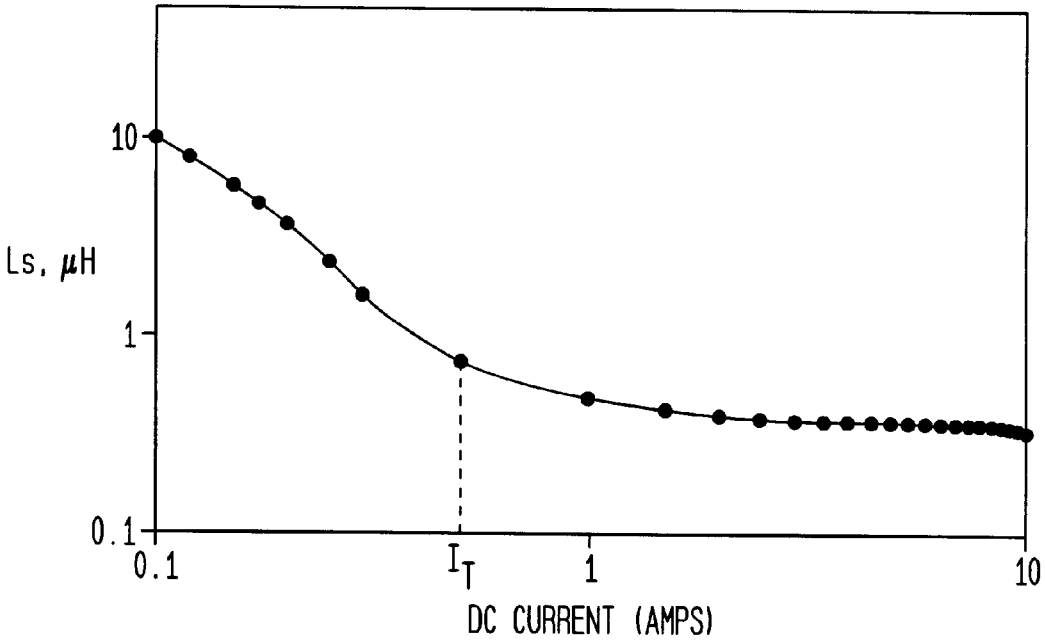
FIG. 1 is a graphical illustration showing the inductance versus current characteristics for a conventional device.

FIG. 1 is a graphical illustration showing the inductance versus current characteristic for a typical device in accordance with U.S. Pat. No. 5,574,420. As can seen, as the current through the winding path increases, the inductance of the device gradually decreases from a high initial inductance. Then at a reasonably well defined threshold current $I_T$, the inductance ceases decreasing and remains at a relatively constant value despite further increases in the winding current.

Figure 2:
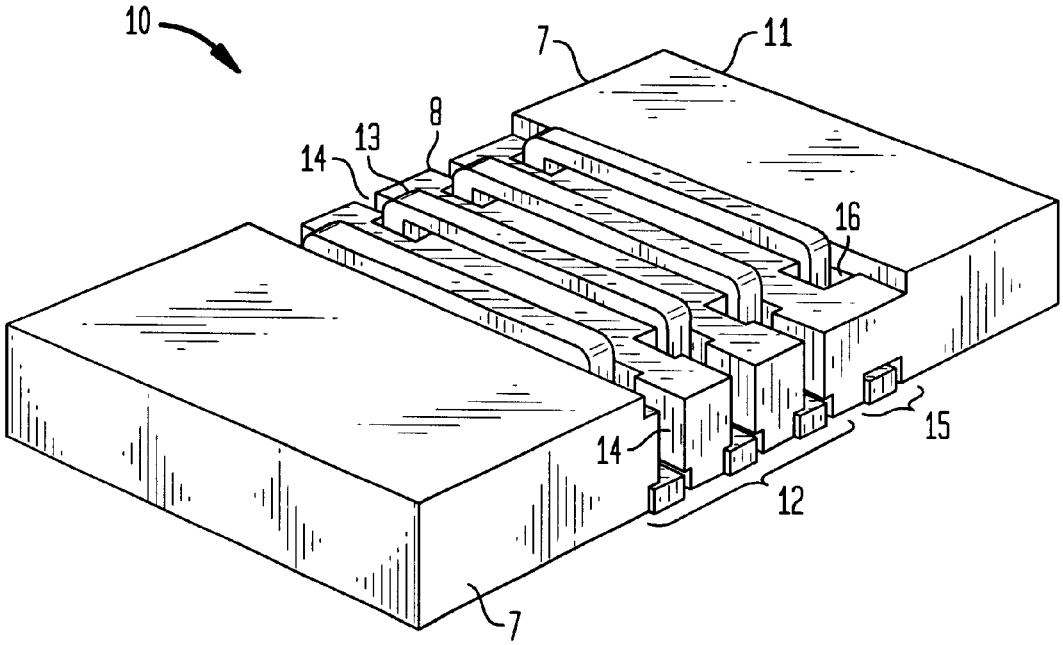
FIG. 2 is a perspective view of an exemplary magnetic device having a controllable inductance versus current characteristic.

FIG. 2 illustrates a surface mount magnetic device 10 wherein the threshold current can be adjusted. The device 10 comprises a crenelated body 11 of magnetic material such as ferrite having a first coil 12 formed of conductive elements 13 partially surrounding the body. The body 11 has crenelated sides 7 including alternating projections 8 and recesses (notches) 14. The elements 13 can extend through one or more notches 14 in opposing edges of the body. One or more can extend through openings in the body. A second conductive coil 15 surrounding the body extends through apertures 16 in the body 11. The device exhibits a nonlinear inductance versus first coil current characteristic having a threshold controlled by the control current applied to the second coil 15.

Either or both the coils 12, 15 can be comprised of conductive elements 13 in the form of U-shaped elements (staples) that partially surround the body 11 and connect to printed strips on a supporting substrate as shown in U.S. Pat. No. 5,574,420. Here apertures or recessed regions in the body hold the U-shaped elements in position. Alternatively, the coils 12 can be comprised of conductive elements 13 in the form of strips printed around the body 11 as shown in U.S. Pat. No. 6,094,123. Here projecting regions between successive strips separate the strips and prevent unwanted short circuits. In each instance the magnetic body has crenelated side surfaces including recessed regions, and the conductive elements 13, whether separate from the body or printed thereon, pass around the sides within the recessed regions.

In general, the more current through the second coil 15, the lower the threshold current ($I_T$ in FIG. 1). Thus a DC current in second coil 15 of less than 1 can shift $I_T$ close to 0.1, providing a device having a relatively constant inductance for a wide range of current in the first coil 12. The second coil can thus reduce the threshold to less than ⅕ its original value. The inductance can be made essentially constant for first coil currents greater than about 0.1 A and less than about 10 A.

Figure 3:
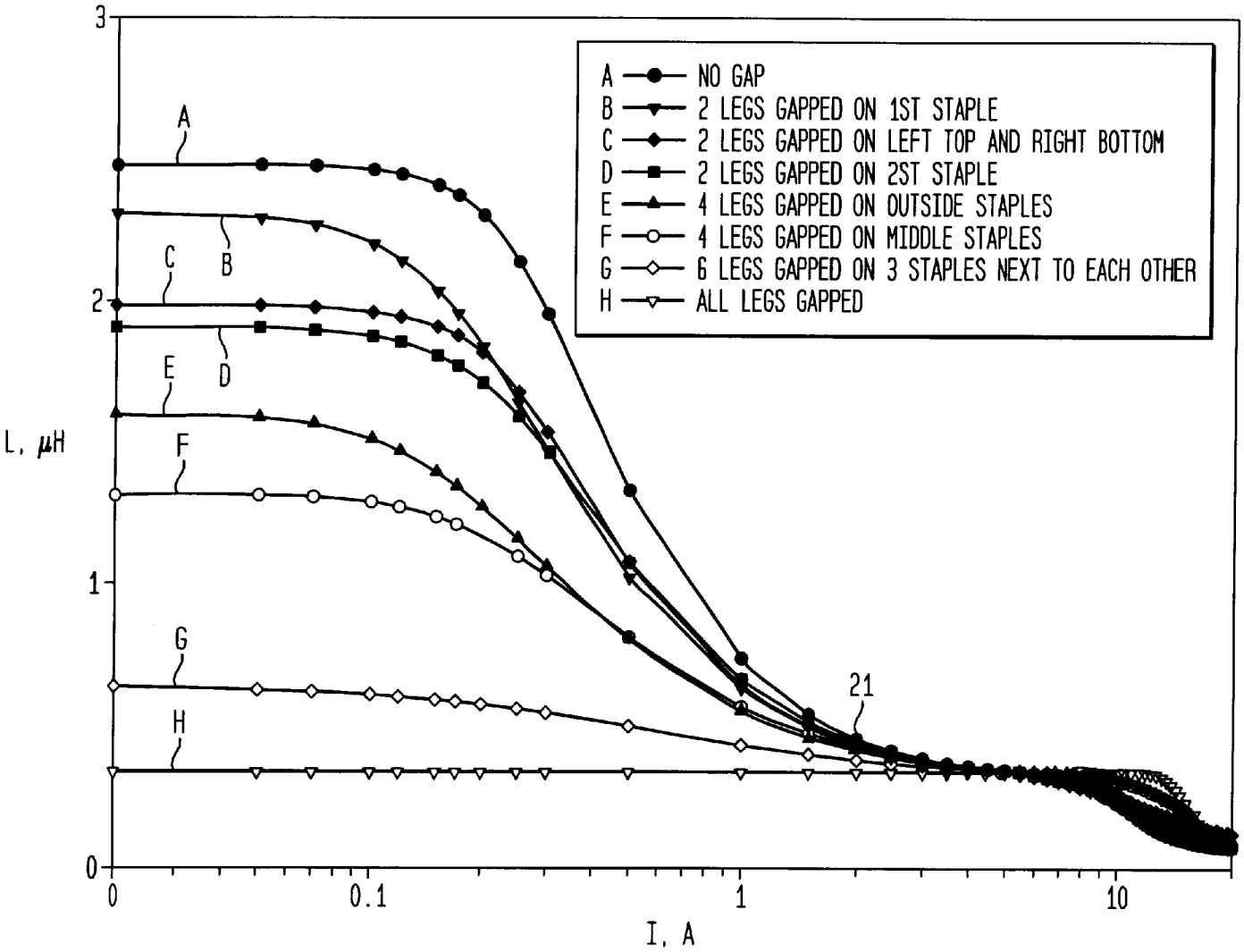
FIG. 3 is graphical illustration showing the inductance versus current characteristics for several different embodiments of the FIG. 2 device.

The difference in inductance between the high inductance state and the low inductance state depends on the presence or absence of notches (gaps) 14 adjacent the individual coils forming the first coil 12. FIG. 3 is a graphical illustration showing the inductance versus current characteristics for several different gap arrangements. As can be seen, the greatest difference occurs in curve A corresponding to a device devoid of notches 14. Here the inductance in the high inductance region 20 is more than twice that in the low inductance region 21. The minimum difference occurs in curve H corresponding to a device where all staples (legs) have notches 14.

The invention may now be more clearly understood by consideration of the following specific example.

EXAMPLE

In an exemplary embodiment body 11 is a ferrite material such as manganese-zinc ferrite ($Mn_{1-x}Zn_xFeO_4$) or nickel-zinc ferrite ($Ni_{1-x}Zn_1FeO_4$) where $0<x\leqq 1$. The conductive elements 12 can be copper staples plated with nickel, tin and solder. Alternatively, the elements 12 can be copper plated on the body 11. The body with holes 13 is formed by dry pressing and sintering. Preferably the body is a rectangular parallelepiped having a length L greater than width W and the conductive elements 12 are distributed along the length, each parallel to the width dimension. The staples are inserted into the holes and their ends are bent to the side. Advantageously, Kapton labels (not shown) are placed on the top major surface of the body so that the finished component can be picked up with a vacuum head in assembling magnetic devices on a circuit board. Exemplary dimensions for the body are: height 0.075 in, length 0.375 in, and width 0.220 in. The upper recess T (and also staple thickness) can be 0.012 in and the lower recess 0.007 in. As will be appreciated from these dimensions, the component has a low profile and is highly compact.

It is to be understood that the above-described embodiments are illustrative of only a few of the many possible specific embodiments which can represent applications of the principles of the invention. Numerous and varied other arrangements can be readily devised by those skilled in the art without departing from the spirit and scope of the invention.

What is claimed is:

1. A magnetic device comprising:

a body of magnetic material having crenelated side surfaces comprising projecting regions and recessed regions;

a first conductive winding around the body for the application of a first current, the first conductive winding extending through recessed regions in the crenelated side surfaces and exhibiting an inductance versus current characteristic wherein as the first current is increased beyond a threshold, the inductance decreases to a region of relatively constant inductance; and a second conductive winding around the body for the application of a second current whereby the threshold is controllably altered, the second conductive winding extending through apertures in the body.

2. A magnetic device according to claim 1 wherein the magnetic material comprises a ferrite material.

3. A magnetic device according to claim 2 wherein the first conductive winding extends through apertures in the body of ferrite material.

4. A magnetic device according to claim 1 wherein the first conductive winding comprises a U-shaped conductor extending through recessed regions in the body.

5. A magnetic device according to claim 1 wherein the first conductive winding comprises a U-shaped conductor extending through holes in the body.

6. A magnetic device according to claim 1 wherein the first conductive winding comprises a conductive strip printed around the body.

7. A magnetic device according to claim 1 wherein the inductance versus current characteristic has a region of high inductance and a region of low inductance, the high inductance being at least twice the low inductance.

8. A magnetic device according to claim 1 wherein the inductance is essential constant over first currents in the range 0.1–10 A.

* * * * *